United States Patent [19]

Akkala

[11] Patent Number: 4,534,152

[45] Date of Patent: Aug. 13, 1985

[54] SELF SEALING VACUUMED PACKAGE

[76] Inventor: Walter I. Akkala, 381 Sycamore Sq., Lady Lake, Fla. 32659

[21] Appl. No.: 479,895

[22] Filed: Mar. 29, 1983

[51] Int. Cl.[3] ..... B65B 31/00

[52] U.S. Cl. ..... 53/434; 426/410; 426/413; 426/130; 426/486

[58] Field of Search ..... 53/434, 479, 512; 426/410, 413, 130, 486, 487, 491, 118

[56] References Cited

U.S. PATENT DOCUMENTS

| | | | |
|---|---|---|---|
| 3,108,881 | 10/1963 | Shaw et al. | 53/434 |
| 3,140,185 | 7/1964 | Pinckney | 426/478 |
| 3,216,832 | 11/1965 | King | 53/433 |
| 3,261,140 | 7/1966 | Long et al. | 53/428 |
| 3,545,983 | 12/1970 | Woods | 53/433 |
| 3,869,842 | 3/1975 | Verbeke | 53/479 |

*Primary Examiner*—Francis S. Husar

*Assistant Examiner*—Linda McLaughlin

*Attorney, Agent, or Firm*—John B. Dickman, III

[57] ABSTRACT

Packaging of certain products like cheese is usually done in a vacuum without the presence of heat. Heretofore, a first vacuum was necessary to knit the curds together and to compact the cheese. A second vacuum was then employed to remove air which returned to the package. The present method eliminates the need for the second vacuum. A heat sealable package, containing cheese, and having a tortuous vent passage is subjected to a vacuum. As a full vacuum is achieved, air within the chamber and the package is exhausted. When the chamber is returned to atmospheric pressure, the tortuous seal collapses to form a temporary seal. At the same time, the plastic bag collapses around the cheese which causes the curds to knit together, and compact the cheese. While still in the sealed condition, a permanent heat seal is made across the tortuous vent passage.

2 Claims, 5 Drawing Figures

SELF SEALING VACUUMED PACKAGE

BACKGROUND OF THE INVENTION

Although this method addresses itself to the packaging of cheese curds, it is also applicable to the packaging of perishable foods, or any other product one may wish to vacuum package.

Prior methods of vacuum packaging cheese do not provide a one step method for evacuating the air from a package of cheese, while knitting the curds and compacting the cheese, and simultaneously sealing the package.

The present method for vacuum packing cheese curds is to place the cheese in a plastic bag which is contained by a rigid container. With the open end of the bag folded down on top of the cheese product, a cover is clamped on the rigid container and the container is placed in a vacuum chamber and subjected to a vacuum. After a vacuum is achieved and the container is removed from the vacuum chamber, the cover is removed, the plastic bag is unfolded and the open end is flared. A clamping mechanism is applied to the flared open end to hold the sides of the bag together in a flat manner. A vacuum nozzle is placed in the bag and a vacuum is applied to the product to remove the air which reentered the bag when it was opened. The bag is then sealed.

The first vacuum causes the cheese curds to knit, this step takes place in the vacuum chamber. The second vacuum, which is applied outside the vacuum chamber, is to form a vacuum in the bag prior to the final seal.

A search of the U.S. Patents developed the following patents on vacuum packaging:

U.S. Pat. No.: 2,541,674, U.S. Pat. No.: 2,708,067, U.S. Pat. No. 3,108,881, U.S. Pat. No.: 3,149,772, U.S. Pat. No.: 3,261,140.

The closest known patent to the present invention is U.S. Pat. No. 3,108,881, issued to Shaw. The method used by Shaw to package foods includes a tortuous vent passage and heat to vaporize a liquid in the package to purge the air. The package is cooled to condense the vapor, forming a temporary seal and collapsing the package. Afterwards, the package is heat sealed to prevent ingress of air. The basic differences in the Shaw method and the present invention is the use of heat to vaporize the liquid and the manner of heat sealing the package. In the present invention, no heat is used since certain products will not tolerate heat without undergoing changes. The method of heat sealing the package in the present invention insures a complete seal, whereas the seal in the Shaw package is along one of the interrupted bend lines forming the tortuous vent passage.

There are at least two well known methods of forming vacuum packages which are worth mentioning as background to the present invention. The first method employs a flexible package in which the product is placed where the open end of the package closes around a vacuum probe. Gases are evacuated from the package through the probe, which is removed and the package heat sealed.

In the other accepted method, filled packages are placed in a vacuum chamber and the container is closed. After the chamber is evacuated, the packages are remotely sealed while still in the chamber and then the chamber is opened. The problem with this method is two fold: (1) the equipment for remote sealing is expensive, and (2) the quality control of the seals would be difficult to regulate.

SUMMARY OF THE INVENTION

A method for vacuum packaging cheese curds and the like in a heat sealable plastic package, including:

placing a plastic bag inside a supportive, confining container which is of a predetermined rigidity and configuration;

placing the cheese curds in the plastic bag and forming a tortuous vent passage in the open end;

clamping a two section cover on the cntainer through which the sealed area protrudes;

putting the container in a vacuum chamber, sealing said chamber, and drawing a vacuum to remove gases from the chamber and the plastic bags through the tortuous vent channel;

returning the vacuum chamber to normal atmospheric pressure, which causes the tortuous vent channel to temporarily seal itself, while simultaneously compacting the cheese because of the pressure exerted on the exterior of the bag; and making a final permanent seal across the tortuous vent channel.

BRIEF DESCRIPTION OF THE DRAWINGS

FIG. 3 is a top plan view of the bag in the rigid container and having the cover clamped on.

DESCRIPTION OF THE INVENTION

Figure 5:
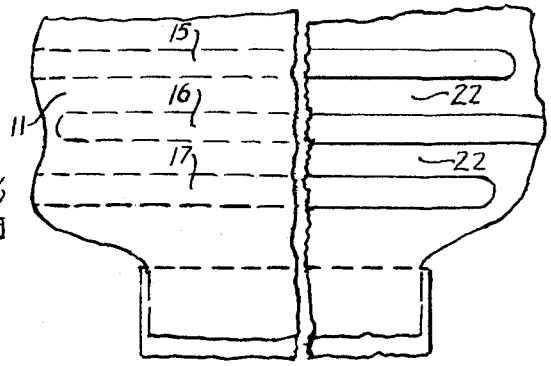
FIG. 5 is an enlarged elevational view of a portion of said bag showing the tortuous vent seals.

In the drawings, a rigid container 10, is selected which determines the final configuration of the product at the end of the packaging process. A heat sealable plastic bag 11, is inserted inside the container 10. A product 12, which can be of any nature which is compatible to vacuum packaging, is placed in the bag 11. This invention is particularly suited to packaging perishable products, both those intolerant to heat, as well as those that can withstand heat. A heat sealing unit is used to form a specific pattern of tortuous vent passage 22. The tortuous vent passage is composed of two or more parallel heat seal bond lines which extend from opposite sides of the bag almost, but not quite, the full width of the bag. The tortuous vent 22 is formed of three separate parallel bond lines 15, 16 and 17. The bond line 15 is disposed uppermost and is discontinued short of 14 adjacent the right edge, leaving a passage 23. The bond line 16 is disposed parallel the bond line 15 and is discontinued short of 13 adjacent the left edge. Bond line 17 is the lowermost and is discontinued short of 14 near the right edge. It is apparent that the seals 15, 16, and 17 define a tortuous vent passage 22 which is of the maze type. This passage is only one of many tortuous vent passages which may be used. FIG. 5 shows an enlargement of the seal area just described which more clearly defines the tortuous vent passage 22.

A two-section cover 18 is placed on container 10 in a manner which allows the tortuous seal portion 15, 16 and 17 to protrude through the cover opening 24.

Figure 2:
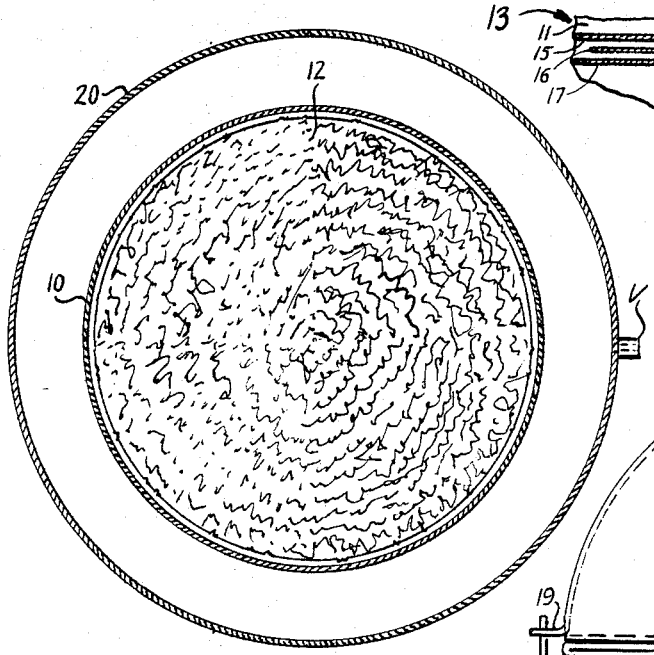
FIG. 2 is a sectional view taken on the line 2—2 in FIG. 1.
Figure 4:
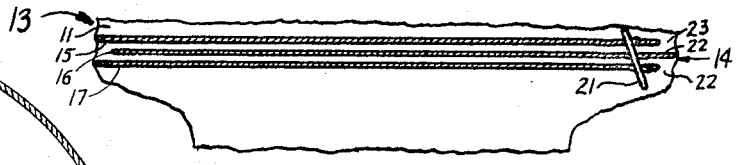
FIG. 4 is an elevational view of a portion of the bag with the final transverse diagonal heat seal applied.
Figure 3:
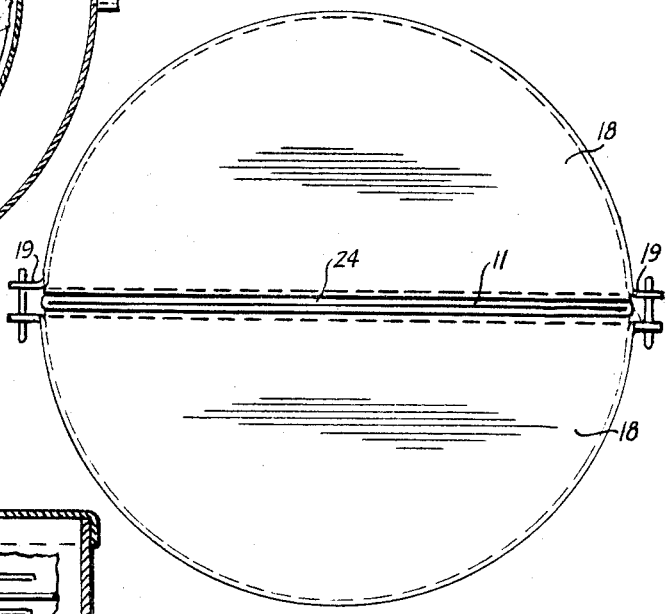
Figure 1:
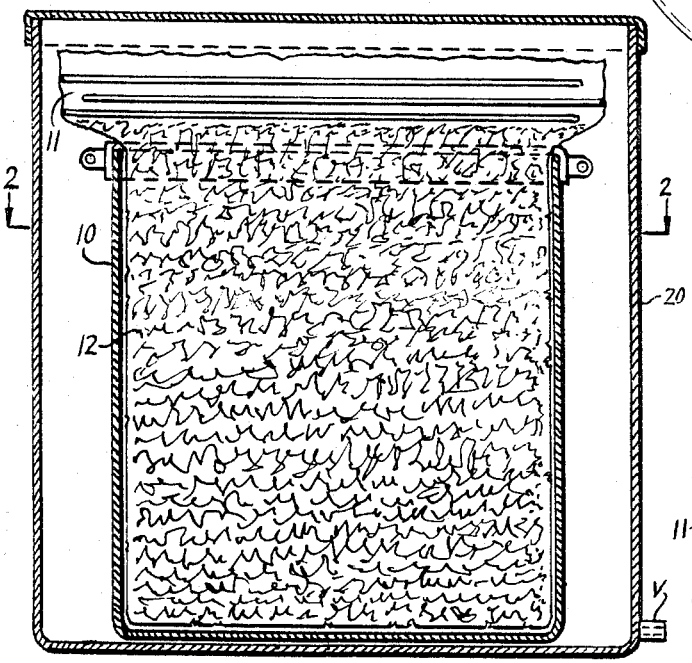
FIG. 1 is an elevational view, partly in section, showing the filled bag in the rigid container in the vacuum chamber.

Cover then is clamped to container 10. FIG. 3 shows a top view of two-section cover 18 showing opening 24, and clamps 19. Container 10 is placed into vacuum chamber 20. The chamber is sealed and evacuated, removing the gases from the bag 11 through the tortuous passage 22, and out of vent 23. Confining container 10 and cover 18 prevent the plastic bag from ballooning and subsequently bursting during evacuation process. After a suitable vacuum has been achieved, chamber is returned to normal atmospheric pressure. The atmospheric pressure that is exerted on the exterior of the package creates the force which simultaneously temporarily seals the tortuous vent passage and collapses the plastic bag thereby compacting the product within. Container 10 is removed from vacuum chamber 20. Two-section covers 18 are unclamped and removed. A cross seal 21 is made diagonally across seals 16, 17 and 18 to permanently seal bag 11. This cross seal 21 may be made in a variety of ways. It is possible to seal the bag by a bond across either bonds 15 and 16, or 16 and 17. However, a transverse bond 21 across bonds 15, 16 and 17 ensures that the bag is permanently sealed.

The bag 11 may be of any gas impervious plastic either incorporating a metal layer or additional impervious layers or not. Some heat sealable plastics such as polyethylene, polypropylene, Mylar and similar plastics are known to work well. The invention is not directed to any specific plastic, therefore, any commercially available heat sealable plastic which is impervious to gases is acceptable as long as it is not harmful to the product to be packed.

It is contemplated that other methods of forming the bonds such as 15, 16, 17 and 21 can be used instead of heat sealing. For example, ultrasonic bonds have been used to bond thermoplastic materials, and such bonds would work well in the present method.

While one method for packing cheeses and the like has been disclosed, it is understood that one skilled in the art could, upon studying the present invention, develop other methods. Therefore, one should study the appending claims for a full understanding of the invention.

I claim:

1. A method for vacuum packaging heat sensitive powdered products and perishable cheese products and knitting the cheese curds using a vacuum, comprising; placing a cheese product in a thermoplastic bag impervious to the ingress of atmospheric air and forming a tortuous vent passage in the open end of the bag above the product; placing the filled bag in a supportive container having a two section cover through which the tortuous vent portion protrudes to prevent the bag from expanding and bursting when subjected to a vacuum; placing the supportive container in a vacuum chamber and subjecting it to a vacuum to remove air within the bag through the formed tortuous vent passage; opening the vacuum chamber collapsing the tortuous vent passage and creating a temporary seal and collapsing the bag around the product causing it to compact the product, removing the vacuumized filled bags from the supportive container and vacuum chamber; and permanently sealing the tortuous vent passage diagonally transversing at least one or more of the passage sections of the tortuous vent passage.

2. The method of claim 1, whereby all packages in said vacuum chamber will reach identical vacuum pressure, thereby providing quality control.

* * * * *